US006209782B1

(12) United States Patent
Chou et al.

(10) Patent No.: US 6,209,782 B1
(45) Date of Patent: Apr. 3, 2001

(54) PACKAGING BOX WITH A FOLDABLE HANDLE MEMBER

(75) Inventors: Ming-Hsun Chou; Shu-Chin Chen, both of Taipei (TW)

(73) Assignee: Compal Electronics, Inc., Taipei (TW)

( * ) Notice: Subject to any disclaimer, the term of this patent is extended or adjusted under 35 U.S.C. 154(b) by 0 days.

(21) Appl. No.: 09/556,616

(22) Filed: Apr. 20, 2000

(51) Int. Cl.[7] ..... B65D 5/46
(52) U.S. Cl. ..... 229/117.15; 229/117.22
(58) Field of Search ..... 229/117.15, 117.22, 229/117.24

(56) References Cited

U.S. PATENT DOCUMENTS 1,731,414 * 10/1929 Grossman ..... 229/117.15
2,638,262 * 5/1953 Mulnix ..... 229/117.15
2,693,310 * 11/1954 Stopper ..... 229/117.15
3,115,294 * 12/1963 Gatward ..... 229/117.24
3,126,140 * 3/1964 Lizan et al. ..... 229/117.22
3,140,813 * 7/1964 Hall et al. ..... 229/117.22
4,003,515 * 1/1977 Steele ..... 229/117.15
4,171,763 * 10/1979 Card ..... 229/117.15
4,339,070 * 7/1982 Davies ..... 229/117.24
4,895,295 * 1/1990 Montgomery et al. ..... 229/117.24

* cited by examiner

*Primary Examiner*—Gary E. Elkins
(74) *Attorney, Agent, or Firm*—Pillsbury Winthrop LLP

(57) ABSTRACT

A packaging box includes at least two opposite side walls and a foldable handle member. The side walls have upper edges, and inner and outer cover plates connected hingeably and respectively to the upper edges. The outer cover plate overlies the inner cover plate, and has a slot formed therein. The foldable handle member is connected to the inner cover plate. The foldable handle member projects from a plane parallel to the inner cover plate when the foldable handle member is folded to an upright position. The foldable handle member is located in the plane parallel to the inner cover plate when the foldable handle member is unfolded. The foldable handle member projects through the slot in the outer cover plate when the foldable handle member is folded to the upright position.

2 Claims, 10 Drawing Sheets

PACKAGING BOX WITH A FOLDABLE HANDLE MEMBER

BACKGROUND OF THE INVENTION

1. Field of the Invention

This invention relates to a packaging box, more particularly to a packaging box with a foldable handle member.

2. Description of the Related Art

Referring to FIG. 1, a conventional packaging box is shown to comprise a hollow body 10 made of a paperboard material. The hollow body 10 has a top opening 11, and two opposed pairs of side walls 100. The side walls 100 have two opposed side cover plates 12, an inner cover plate 13 and an outer cover plate 14 connected hingeably and respectively to upper edges thereof. An insertion slit 131 is formed along a folding line between the inner cover plate 13 and one of the side walls 100. A hingeable retaining plate 101 is formed adjacent to the slit 131 on one of the side walls 100. The outer cover plate 14 has an insertion plate 141 hinged to a distal edge thereof. A retaining slit 142 is formed along a folding line between the outer cover plate 14 and the insertion plate 141. To close the opening 11, the side cover plates 12 are turned inwardly and the inner cover plate 13 is then turned inwardly for folding over the side cover plates 12. Thereafter, the outer cover plate 14 is folded over the inner cover plate 13. Finally, the insertion plate 141 of the outer cover plate 14 is inserted into the insertion slit 131, and the retaining plate 101 is inserted into the retaining slit 142 in order to lock the inner and outer cover plates 13, 14 to one another. To carry the packaging box, a handle 15 formed from a plastic strip is connected to the outer cover plate 14. The handle 15 has two ends that are retained respectively in two holes 143 formed in the outer cover plate 14, as best illustrated in FIG. 2. As such, the user can grip the handle 15 for carrying purposes.

However, the aforementioned conventional packaging box suffers from the following disadvantages:

1. Since the handle 15 is made from a plastic material, the handle 15 does not easily decompose after being discarded, thereby resulting in an environmental problem.
2. The handle 15 must be manufactured and assembled to the body 10 separately. Accordingly, the cost of the conventional packaging box is increased.

SUMMARY OF THE INVENTION

The object of the present invention is to provide a packaging box that can overcome the disadvantages commonly associated with the aforementioned conventional packaging box.

According to the present invention, the packaging box includes at least two opposite side walls and a foldable handle member. The side walls have upper edges, and inner and outer cover plates connected hingeably and respectively to the upper edges. The outer cover plate overlies the inner cover plate, and has a slot formed therein. The foldable handle member is connected to the inner cover plate. The foldable handle member projects from a plane parallel to the inner cover plate when the foldable handle member is folded to an upright position. The foldable handle member is located in the plane parallel to the inner cover plate when the foldable handle member is unfolded. The foldable handle member projects through the slot in the outer cover plate when the foldable handle member is folded to the upright position.

In a preferred embodiment, the foldable handle member has a hinge edge connected hingeably to the inner cover plate, a distal edge opposite to the hinge edge, and a first folding line extending parallel to and intermediate of the distal edge and the hinge edge to form first and second abutting portions at either sides of the first folding line. The first and second abutting portions abut against one another when the foldable handle member is folded.

As disclosed herein, the inner cover plate further has a second folding line parallel to the first folding line and adjacent to the distal edge thereof to form a support portion between the second folding line and the distal edge. The first and second abutting portions have holes formed therein and aligned with one another when the first and second abutting portions abut against one another. The support portion has an outer face that is disposed under and that abuts against an inner face of the inner cover plate when the foldable handle member is folded to the upright position, and an inner face that is disposed under and that abuts against the inner face of the inner cover plate when the foldable handle member is folded and turns to lie in the plane parallel to the inner cover plate.

Preferably, one of the first and second abutting portions has a padding plate connected hingeably thereto adjacent to a corresponding one of the holes thereof. The padding plate extends through the holes in a direction perpendicular to the first and second abutting portions under a part of the foldable handle member when the foldable handle member is folded to the upright position.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
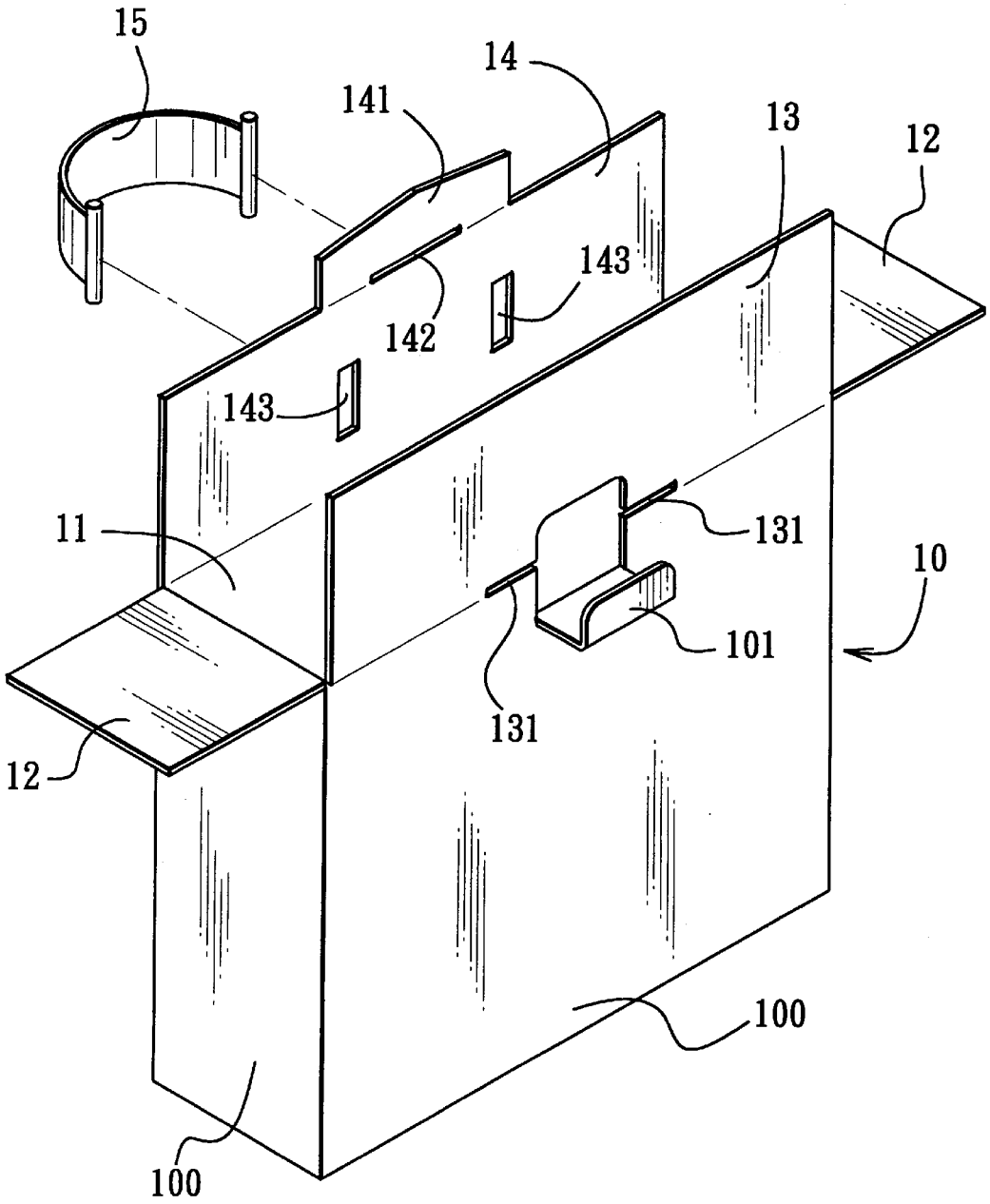
F I G. 1 PRIOR ART
FIG. 1 is an exploded perspective view of a conventional packaging box.
Figure 2:
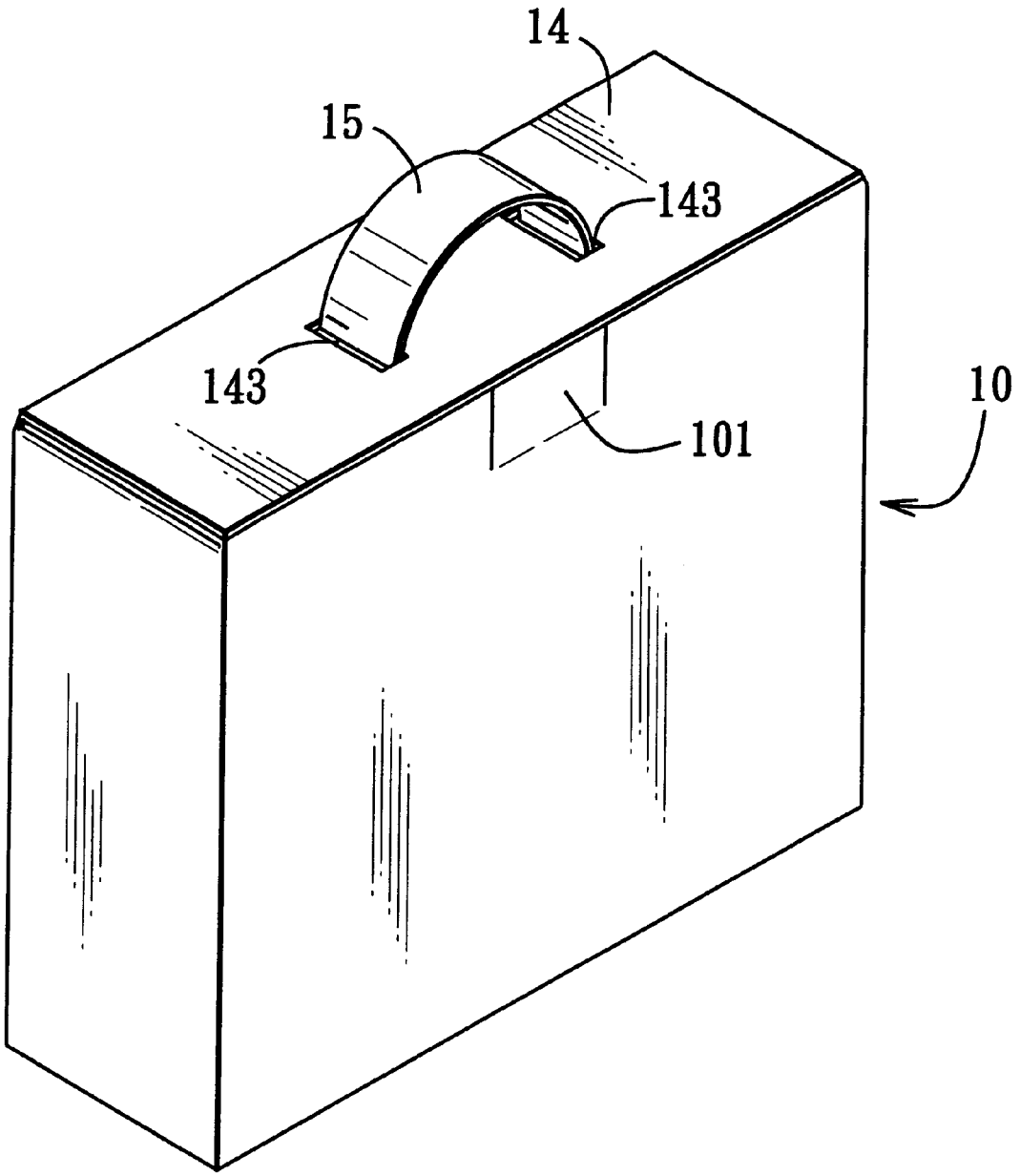
F I G. 2 PRIOR ART
FIG. 2 is a perspective view of the conventional packaging box of FIG. 1.
Figure 3:
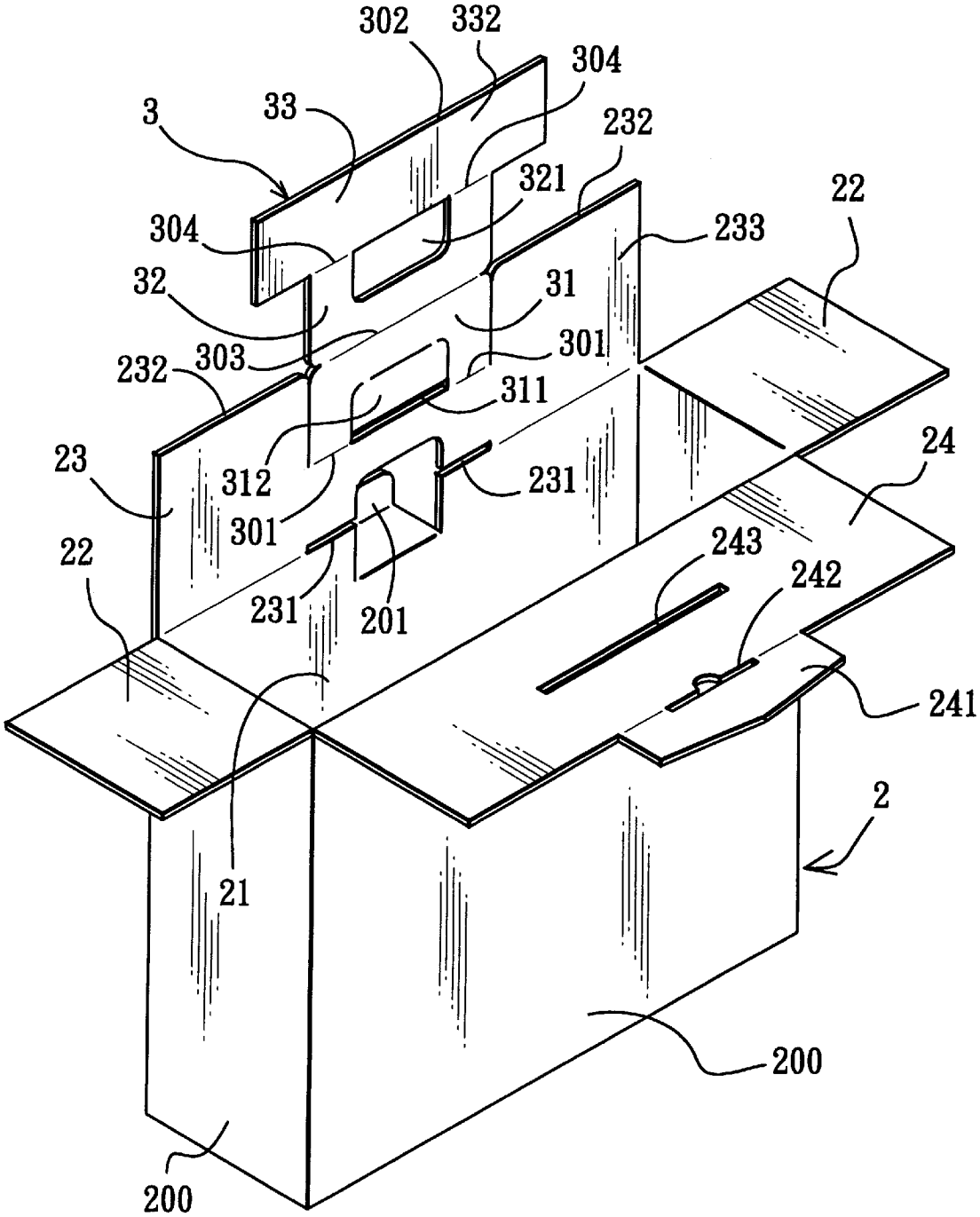
FIG. 3 is a perspective view of a preferred embodiment of a packaging box according to the present invention.

Referring to FIG. 3, a preferred embodiment of a packaging box according to the present invention is shown to include a hollow body 2 made of a paperboard material. The hollow body 2 has a top opening 21, and two opposed pairs of side walls 200. The side walls 200 have two opposed side cover plates 22, an inner cover plate 23 and an outer cover plate 24 connected hingeably and respectively to upper edges thereof in a manner similar to that in the aforementioned conventional packaging box. An insertion slit 231 is formed along a folding line between the inner cover plate 23 and one of the side walls 200. A hingeable retaining plate 201 is formed adjacent to the insertion slit 231 on one of the side walls 200. The outer cover plate 24 has an insertion plate 241 hinged to a distal edge thereof, and a slot 243 formed in the outer cover plate 24. A retaining slit 242 is formed along a folding line between the outer cover plate 24 and the insertion plate 241.

Figure 4:
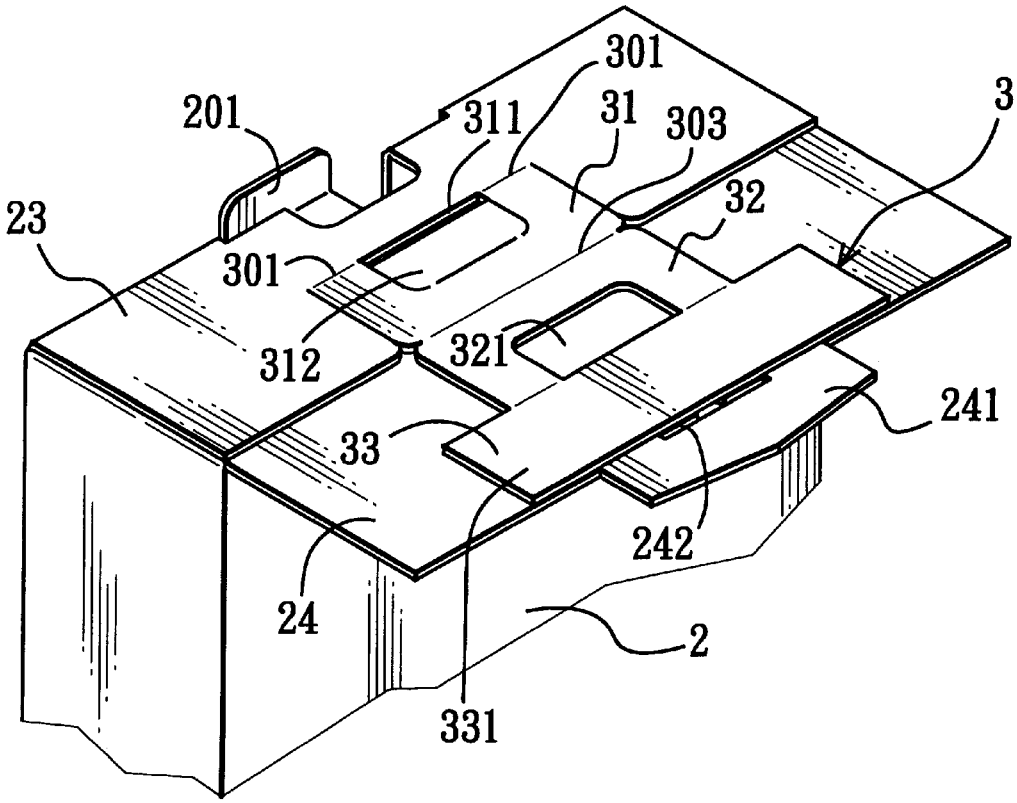
FIG. 4 is a fragmentary perspective view illustrating the preferred embodiment of the packaging box according to the present invention in a first operative position.
Figure 6:
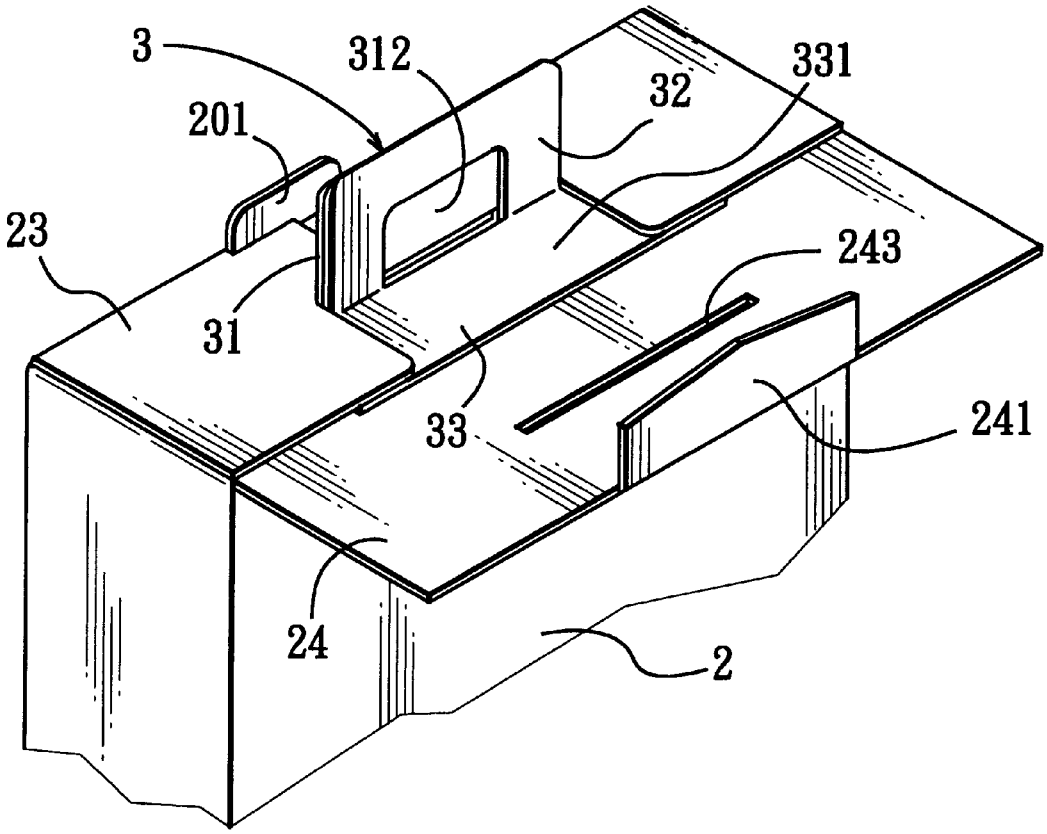
FIG. 6 is a fragmentary perspective view illustrating the preferred embodiment of the packaging box according to the present invention in a third operative position.
Figure 7:
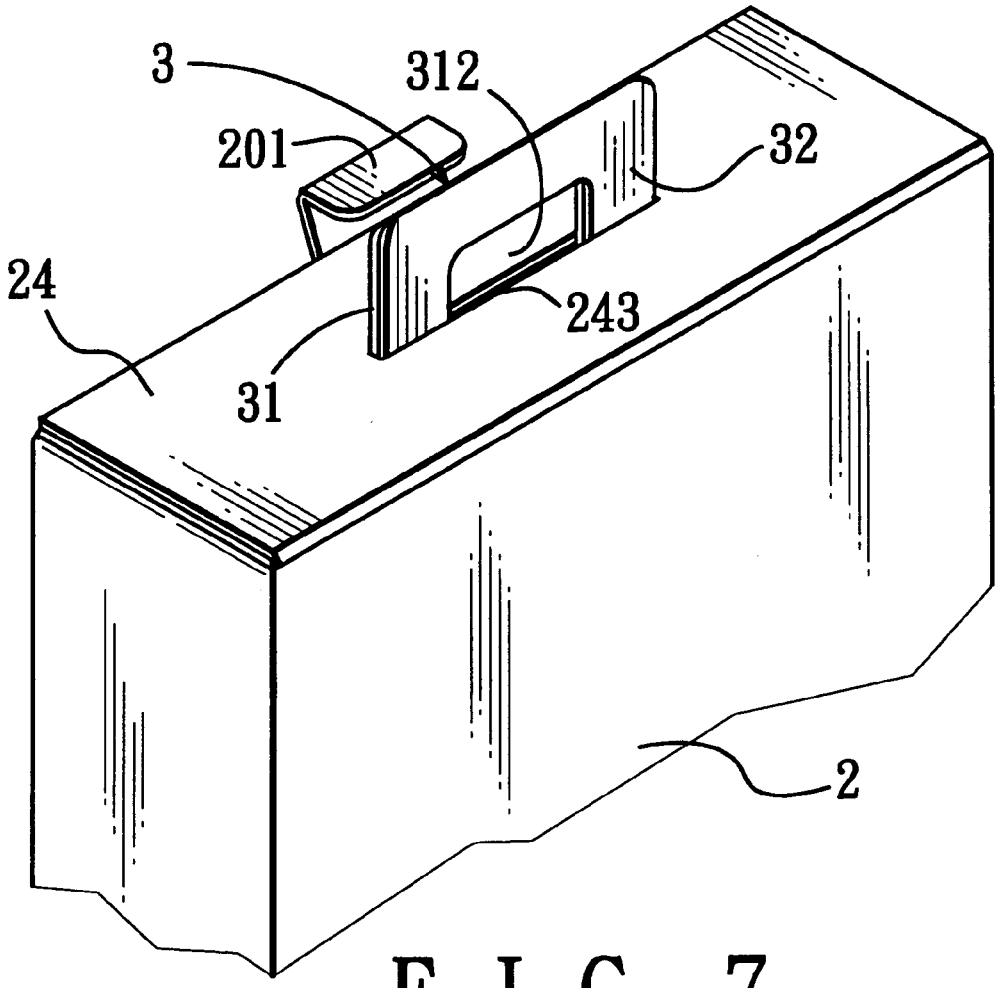
FIG. 7 is a fragmentary perspective view illustrating the preferred embodiment of the packaging box according to the present invention in a fourth operative position.

As shown, the packaging box further has a foldable handle member 3 connected to the inner cover plate 23. The foldable handle member 3 projects from a plane parallel to the inner cover plate 23 when the foldable handle member 3 is folded to an upright position, as best illustrated in FIG. 6. The foldable handle member 3 is located in the plane parallel to the inner cover plate 23 when the foldable handle member 3 is unfolded, as best illustrated in FIG. 4. The foldable handle member 3 projects through the slot 243 in the outer cover plate 24 when the foldable handle member 3 is folded to the upright position, as best illustrated in FIG. 7.

Figure 8:
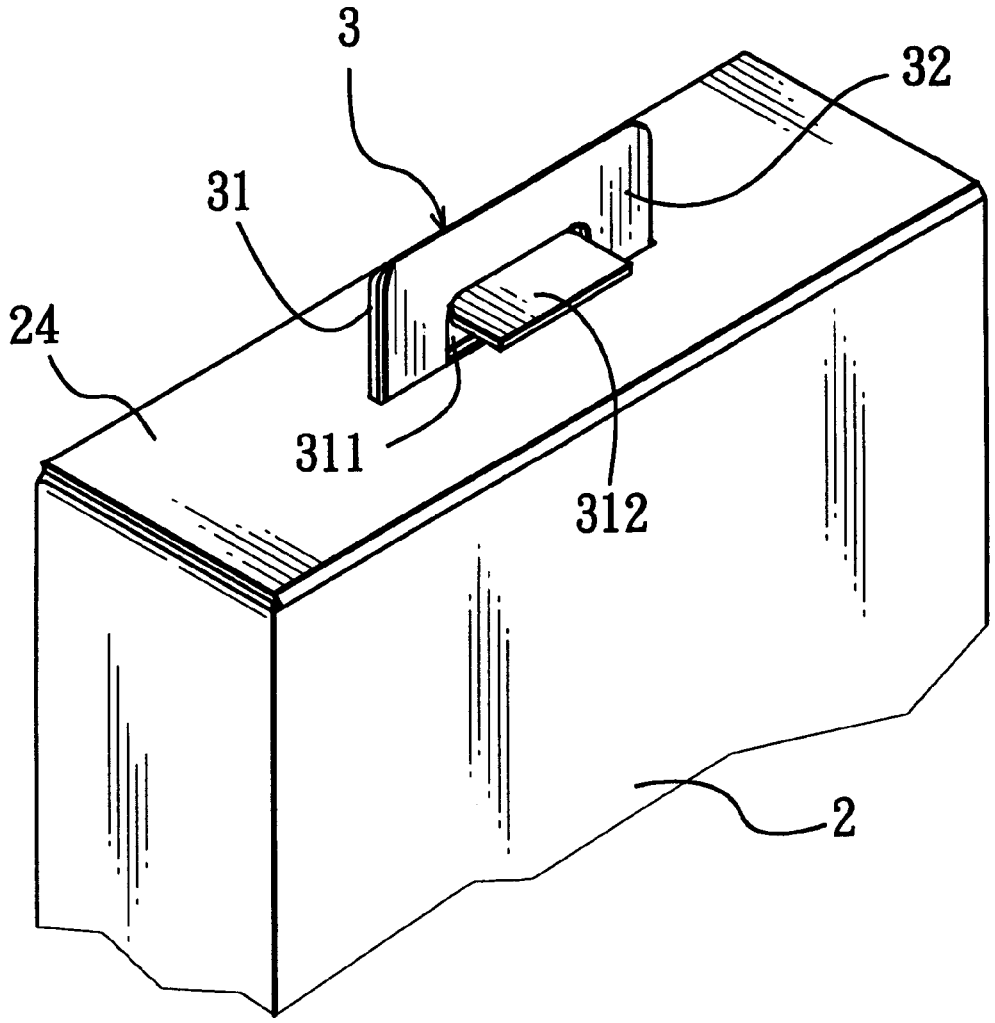
FIG. 8 is a fragmentary perspective view illustrating the preferred embodiment of the packaging box according to the present invention in a fifth operative position.

The foldable handle member 3 has a hinge edge 301 connected hingeably to the inner cover plate 23, a distal edge 302 opposite to the hinge edge 301, and a first folding line 303 extending parallel to and intermediate of the distal edge 302 and the hinge edge 301 to form first and second abutting portions 31, 32 at either sides of the first folding line 303. The first and second abutting portions 31, 32 abut against one another when the foldable handle member 3 is folded, as shown in FIGS. 6, 7, and 8. The first and second abutting portions 31, 32 have holes 311, 321 formed therein and aligned with one another when the first and second abutting portions 31, 32 abut against one another.

Figure 9:
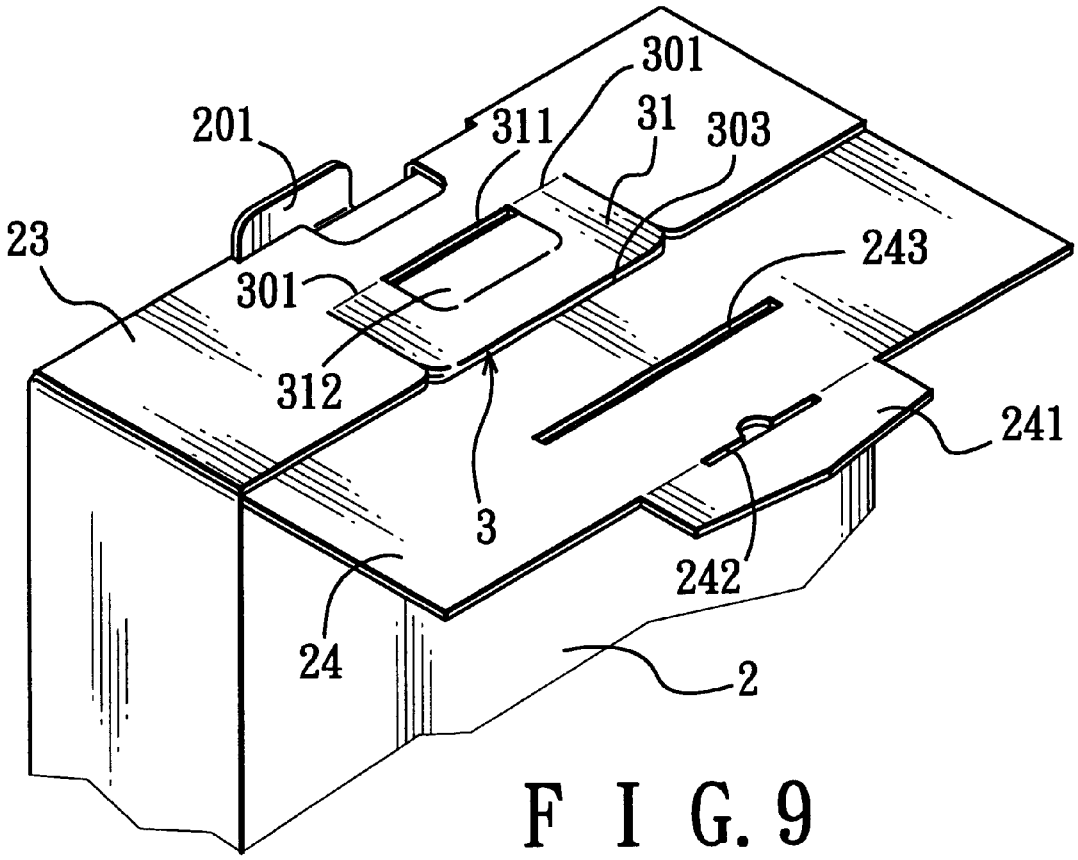
FIG. 9 is a fragmentary perspective view illustrating the preferred embodiment of the packaging box according to the present invention in a sixth operative position.

Referring again to FIG. 3, the inner cover plate 23 further has a second folding line 304 parallel to the first folding line 303 and adjacent to the distal edge 302 thereof to form a support portion 33 between the second folding line 304 and the distal edge 302. The hinge edge 301 is located at an intermediate portion in the width direction of the inner cover plate 23. The first folding line 303 is generally aligned with a distal edge 232 of the inner cover plate 23. The first abutting portion 31 is connected hingeably to the inner cover plate 23 at the hinge edge 301. The support portion 33 has a length that is longer than that of the inner cover plate 23. The support portion 33 has an outer face 331 that is disposed under and that abuts against an inner face 233 of the inner cover plate 23 when the foldable handle member 3 is folded to the upright position, as best illustrated in FIG. 6, and an inner face 332 that is disposed under and that abuts against the inner face 233 of the inner cover plate 23 when the foldable handle member 3 is folded and turned to lie in the plane parallel to the inner cover plate 23, as best illustrated in FIGS. 3 and 9.

The first abutting portion 31 has a padding plate 312 connected hingeably thereto adjacent to the hole 311 thereof. The padding plate 312 extends through the holes 311, 321 in a direction perpendicular to the first and second abutting portions 31, 32 under a part of the foldable handle member 3 for gripping by the user when the foldable handle member 3 is folded to the upright position, as best illustrated in FIG. 8.

Figure 5:
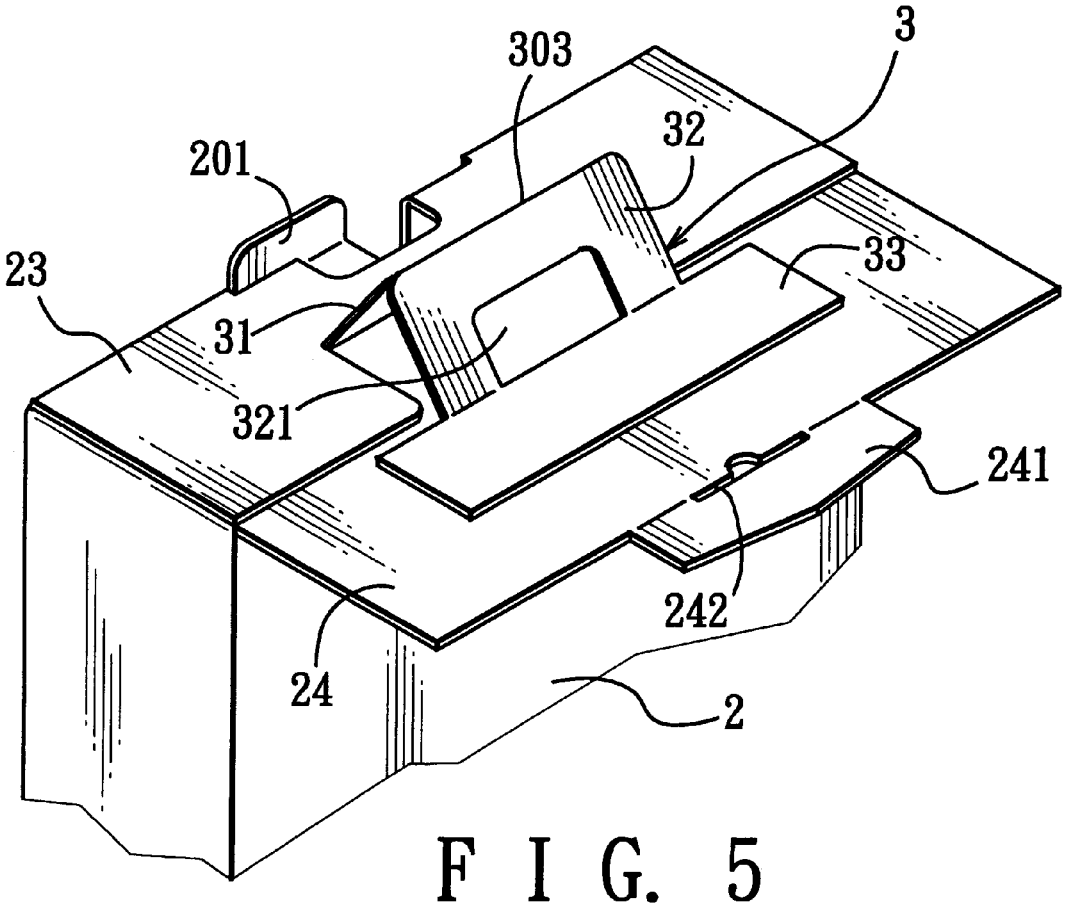
FIG. 5 is a fragmentary perspective view illustrating the preferred embodiment of the packaging box according to the present invention in a second operative position.

When it is desired to carry the packaging box by the foldable handle member 3, the user turns the side cover plates 22 inwardly and folds the inner cover plate 23 over the side cover plates 22, as best illustrated in FIG. 4. Thereafter, the first and second abutting portions 31, 32 are turned about the first folding line 303 to abut against one another, as best illustrated in FIG. 5. The first and second abutting portions 31, 32 protrude from the plane parallel to the inner cover plate 23 in the upright position of the foldable handle member 3. The support portion 33 is disposed under and abuts against the inner cover plate 23, as best illustrated in FIG. 6. Next, the outer cover plate 24 is folded over the inner cover plate 23 to permit the foldable handle member 3 to extend through the slot 243 in the outer cover plate 24. The function of the support portion 33 is to increase the engaging force of the foldable handle member 3 and the inner and outer cover plates 23, 24. Finally, the insertion plate 241 of the outer cover plate 24 is bent and is inserted into the insertion slit 231. The retaining plate 201 is inserted into the retaining slit 242 in order to lock the inner and outer cover plates 23, 24 in a manner similar to that in the aforementioned conventional packaging box, as best illustrated in FIG. 7. In this way, the user can grip a part of the foldable handle member 3 through the holes 311, 321 in the first and second abutting portions 31, 32.

Further, to prevent the pressure exerted by foldable handle member 3 from being concentrated on the fingers of the user along the periphery of the holes 311, 321, which can cause discomfort to the user, the padding plate 312 can be turned to extend through the holes 311, 321 under the part to be gripped by the user in order to provide a large contact surface for the fingers of the user, as best illustrated in FIG. 8. As such, the pressure exerted by the foldable handle member 3 can be uniformly distributed on the padding plate 312, thereby resulting in better comfort for the user.

Figure 10:
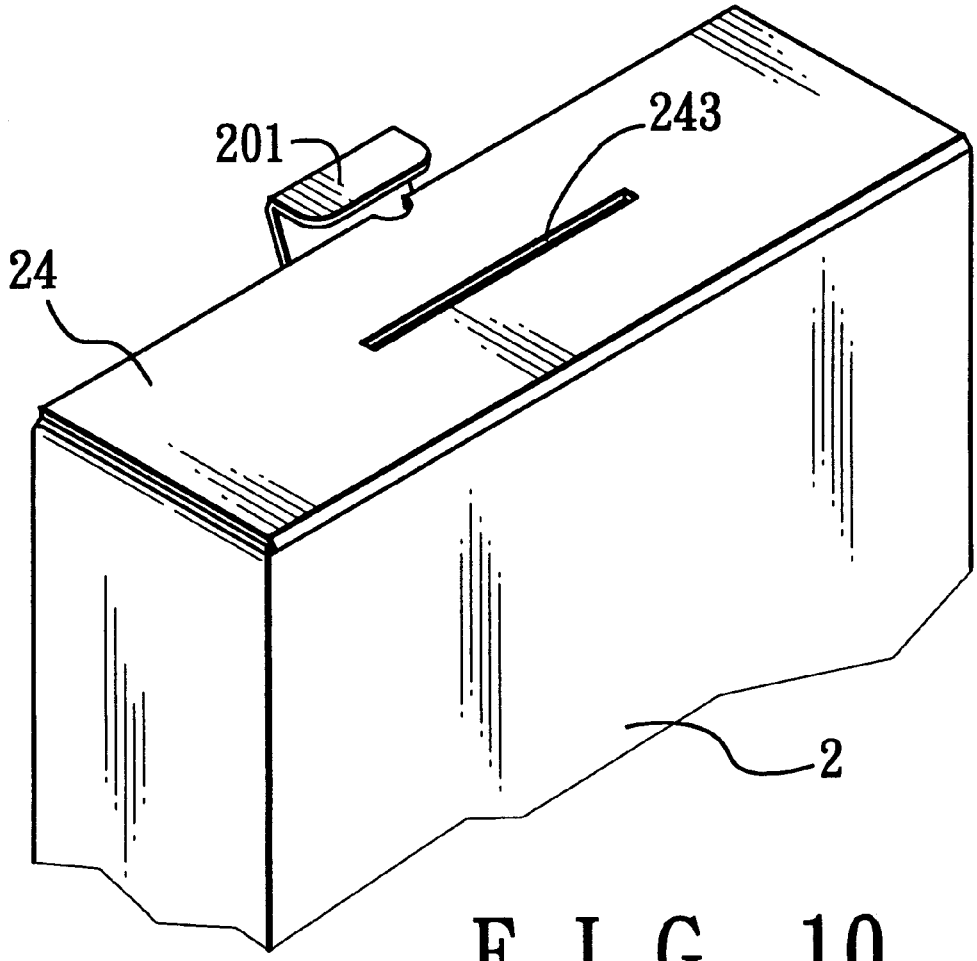
FIG. 10 is a fragmentary perspective view illustrating the preferred embodiment of the packaging box according to the present invention in a seventh operative position.

On the other hand, when it is desired to stack or transport a plurality of the packaging boxes, the foldable handle member 3 can be folded along the first folding line 303 to permit the second abutting portion 32 and the support portion 33 to lie under the inner cover plate 23, as best illustrated in FIG. 9. The outer cover plate 24 is then folded over the inner cover plate 23, as best illustrated in FIG. 10. As such, the foldable handle member 3 will not project from the outer cover plate 24, thereby facilitating stacking and transport of the packaging boxes.

The advantages of the packaging box of the present invention are as follows:

1. Since the body 2 and the foldable handle member 3 are made of the same material, the foldable handle member 3 can be formed simultaneously with the body 2, thereby reducing the material and manufacturing costs.
2. The whole packaging box can be made of a paperboard, thereby avoiding the environmental problem encountered in the aforementioned conventional packaging box.
3. The foldable handle member can be concealed under the inner and outer cover plates 23, 24. This facilitates stacking and transport of the packaging box.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

What is claimed is:

1. A packaging box comprising:

at least two opposite side walls having upper edges, and inner and outer cover plates hingeably connected and respectively to said upper edges, said outer cover plate overlying said inner cover plate and having a slot formed therein; and a foldable handle member connected to said inner cover plate, said foldable handle member protecting from a plane parallel to said inner cover plate when said foldable handle member is folded to an upright position, said foldable handle member being located in the plane parallel to said inner cover plate when said foldable handle member is unfolded, said foldable handle member projecting through said slot in said outer cover plate when said foldable handle member is folded to said upright position, wherein said foldable handle member has a hinge edge hingeably connected to said inner cover plate, a distal edge opposite to said hinge edge, and a first folding line extending parallel to and intermediate of said distal edge and said hinge edge to form first and second abutting portions at either sides of said first folding line, said first and second abutting portions abutting against one another when said foldable handle member is folded;

wherein said inner cover plate further has a second folding line parallel to said first folding line and adjacent to said distal edge thereof to form a support portion between said second folding line and said distal edge, said first and second abutting portions having holes formed therein and aligned with onoe another when said first and second abutting portions abut against one another, said support portion having an outer face that is disposed under and that abuts against an inner face of said inner cover plate when said foldable handle member is folded to said upright position, and an inner face that is disposed under and that abuts against said inner face of said inner cover plate when said foldable handle member is folded and turned to lie in the plane parallel to said inner cover plate.

2. The packaging box as claimed in claim 1, wherein one of said first and second abutting portions has a padding plate connected hingeably thereto adjacent to a corresponding one of said holes thereof, said padding plate extending through said holes in a direction perpendicular to said first and second abutting portions under a part of said foldable handle member when said foldable handle member is folded to said upright position.

* * * * *